US007922223B2

(12) United States Patent
Lawrence

(10) Patent No.: US 7,922,223 B2
(45) Date of Patent: Apr. 12, 2011

(54) SECURITY LOCK FOR A SASH TYPE WINDOW

(76) Inventor: Barry G. Lawrence, Thomasville, NC (US)

( * ) Notice: Subject to any disclaimer, the term of this patent is extended or adjusted under 35 U.S.C. 154(b) by 44 days.

(21) Appl. No.: 12/010,828

(22) Filed: Jan. 30, 2008

(65) Prior Publication Data

US 2009/0189398 A1 Jul. 30, 2009

(51) Int. Cl.
*E05C 3/04* (2006.01)
*E05C 3/14* (2006.01)

(52) U.S. Cl. ..... 292/241; 292/242; 292/DIG. 20; 292/DIG. 47

(58) Field of Classification Search ..... 292/4, 5, 292/67, 128, 194, 197, 200, 203, 210, 228, 292/240–242, 346, DIG. 20, DIG. 45, DIG. 47; 49/449; 70/89, 90
See application file for complete search history.

(56) References Cited

U.S. PATENT DOCUMENTS

| | | | | | |
|---|---|---|---|---|---|
| 520,754 | A * | 5/1894 | Burmeister | 292/65 |
| 528,656 | A * | 11/1894 | Burmeister | 292/65 |
| 4,736,972 | A * | 4/1988 | Mosch | 292/204 |
| 4,801,164 | A * | 1/1989 | Mosch | 292/204 |
| 5,161,839 | A * | 11/1992 | Piltingsrud et al. | 292/241 |
| 5,219,193 | A * | 6/1993 | Piltingsrud | 292/240 |
| 5,741,032 | A * | 4/1998 | Chaput | 292/202 |
| 6,068,306 | A * | 5/2000 | Brautigam | 292/242 |
| 6,116,665 | A * | 9/2000 | Subliskey | 292/241 |
| 6,142,541 | A * | 11/2000 | Rotondi | 292/241 |
| 6,347,820 | B2 * | 2/2002 | Subliskey | 292/346 |
| 6,349,576 | B2 * | 2/2002 | Subliskey | 70/90 |
| 6,412,834 | B1 * | 7/2002 | Waitai et al. | 292/197 |
| 6,568,723 | B2 * | 5/2003 | Murphy et al. | 292/241 |
| 6,588,150 | B1 * | 7/2003 | Wong et al. | 49/183 |
| 6,871,886 | B2 * | 3/2005 | Coleman et al. | 292/241 |
| 7,000,957 | B2 * | 2/2006 | Lawrence | 292/241 |
| 7,063,361 | B1 * | 6/2006 | Lawrence | 292/241 |
| 7,159,908 | B2 * | 1/2007 | Liang | 292/242 |
| D546,166 | S * | 7/2007 | Liang | D8/344 |
| 7,322,620 | B1 * | 1/2008 | Lawrence | 292/242 |
| D562,109 | S * | 2/2008 | Liang | D8/337 |
| 7,665,775 | B1 * | 2/2010 | Miller et al. | 292/240 |
| 2001/0005995 | A1 * | 7/2001 | Subliskey | 70/89 |
| 2003/0151262 | A1 * | 8/2003 | Murphy et al. | 292/241 |

* cited by examiner

*Primary Examiner* — Carlos Lugo
*Assistant Examiner* — Alyson M Merlino
(74) *Attorney, Agent, or Firm* — Birch, Stewart, Kolasch & Birch, LLP

(57) ABSTRACT

A security lock having a housing and a cam. The housing includes an indent with a pair of guide portions. The cam is positioned within the indent and includes an axle port. A shaft of an axle is adapted to be inserted into the axle port so that the cam and the axle are rotatable together. The cam includes a sweep arm and a channel disposed on an upper surface of the sweep arm. The sweep arm has an outer wall that is either elongate-shaped or semicircular-shaped. The channel has a semi-circular-shaped inner wall and an elongate-shaped outer wall. Upon rotation of the axle, the cam rotates about the guide portions into a locked posture in the housing. The elongate-shaped outer wall of the channel allows the security lock to be self-locating when the housing and a keeper are misaligned when installed, respectively, on opposing window sashes.

20 Claims, 3 Drawing Sheets

SECURITY LOCK FOR A SASH TYPE WINDOW

BACKGROUND OF THE INVENTION

1. Field of the Invention

The invention herein pertains to window locks and the like and particularly pertains to a security lock for a window sash. The cam of the security lock includes a sweep arm channel having an elongate-shaped outer wall for engaging a keeper.

2. Description of Background Art

In recent years, burglars have become adapt at opening sash type windows from the outside of a house or other building by first removing the window screen and placing a putty knife or similar thin bladed instrument between the sashes to rotate the cam to an unlocked posture. The blade is used by unauthorized persons to urge the rotatable cam to disengage the cam from the keeper. Once the cam has been disengaged, the sash is then openable for entry purposes. Attempts have been made to secure such windows such as by use of extra locks or by drilling holes in the sash and window frame and inserting nails or steel rods therein for immobilization. However, adding locking devices tends to inconvenience the home or business owner and obstructs the intended function of the window. Certain sash window locks have been designed in the past to prevent unauthorized entry such as shown in U.S. Pat. No. 6,142,541. Another sash window lock, such as disclosed in U.S. application Ser. No. 11/136,066, has a tab that is rotatable in a well of a cam, and a cam that is slidable within the housing.

Window reinforcements, locks and other means to prevent entry are often expensive, inconvenient and are often difficult to use and require extra thought, time and effort by the owner. Sometimes these other means to prevent entry are installed, and when not installed, conventional locks provide little if any protection against unauthorized entry.

SUMMARY AND OBJECTS OF THE INVENTION

Based on the problems and disadvantages associated with conventional locks and locking systems for sash type windows, the present invention was conceived. One of the objectives of the present invention is to provide a sash type window lock which can be mounted on the top rail of the sash for engagement with a keeper mounted on an opposing bottom sash rail when the window is closed.

It is another objective of the present invention to provide a sash type window lock which is handle-operated as with a conventional lock, yet which provides added security, It is still another objective of the present invention to provide a sash type window lock which includes a cam with sweep arm having an outer wall that may be either round or elongated, and a channel with an elongated outer wall formed on an upper surface of the sweep arm for engaging the cam against the catch of a keeper.

Various other objectives and advantages of the present invention will become apparent to those skilled in the art as a more detailed description is set forth below.

The aforesaid and other objectives are realized by providing a lock formed from a plastic composite material, or a metal such as zinc, aluminum or other suitable materials. The preferred form of the lock includes a handle, housing, cam and keeper formed form a standard zinc die-cast material having added security for use on sash type windows and the like. The housing includes an indent with a pair of guide portions. The cam is positioned within the indent and includes an axle port, the axle port having a semi-circular shaped axle port outer wall. A shaft of an axle is adapted to be inserted into the axle port so that the cam and the axle are rotatable together. The cam includes a sweep arm and a channel disposed on an upper surface of the sweep arm. The sweep arm of the cam has an outer wall that is either elongate-shaped or semicircular-shaped. On the other hand, the channel on the upper surface of the sweep arm is bounded on one side by the axle port outer wall and bounded on an opposite side by an elongated-arcuate portion of the inner wall of the sweep arm. The elongated-arcuate portion of the inner wall of the sweep arm allows the security lock to be self locating when the keeper and the housing are misaligned when installed, respectively, on upper and lower sashes of the window.

The housing also includes a groove that is substantially circular-shaped, the groove having an indentation on a wall of the groove. A resilient tension member is disposed in the circular-shaped groove and is rotatable by the axle. The tension member includes at least one projection for engaging with the indentation on the wall of the groove when the axle is rotated to a predetermined position. Upon rotation of the axle, the cam rotates about the guide portions, the projection of the tension member engages with indentation of the groove wall, and the lock is placed into a locked posture. As the cam rotates, a terminal end of the channel of the cam prevents further circular rotation. At the same time, the rotation of the cam causes the cam channel to engulf a keeper catch positioned on an opposing window sashes. As mentioned above, the elongated-arcuate portion of the inner wall of the sweep arm allows the security lock to be self-locating when the keeper and the housing are misaligned when installed, respectively, on upper and lower sashes of the window.

Thus the window cannot be unlocked by such contact as in conventional sash locks. As would be understood, rotation of the cam during locking causes the sweep arm channel to engulf the keeper catch positioned on an opposing window frame or sash as typical.

To unlock the window the handle is merely turned in an opposite direction which disengages both the projection from the indentation of the wall of groove of the housing and the sweep arm channel from the keeper catch, so the window can be opened or moved relative to the opposing window sash or frame.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 11(*a*) illustrates the situation where the housing and keeper of the lock are installed, respectively, on the upper and lower window sashes in positions that are aligned and directly facing each other. On the other hand, FIG. 11(*b*) illustrates the self-aligning capability of the lock in the situation where the housing and keeper of the lock are installed in positions that are misaligned with respect to each other.

DETAILED DESCRIPTION OF THE PREFERRED EMBODIMENTS

Figure 1:
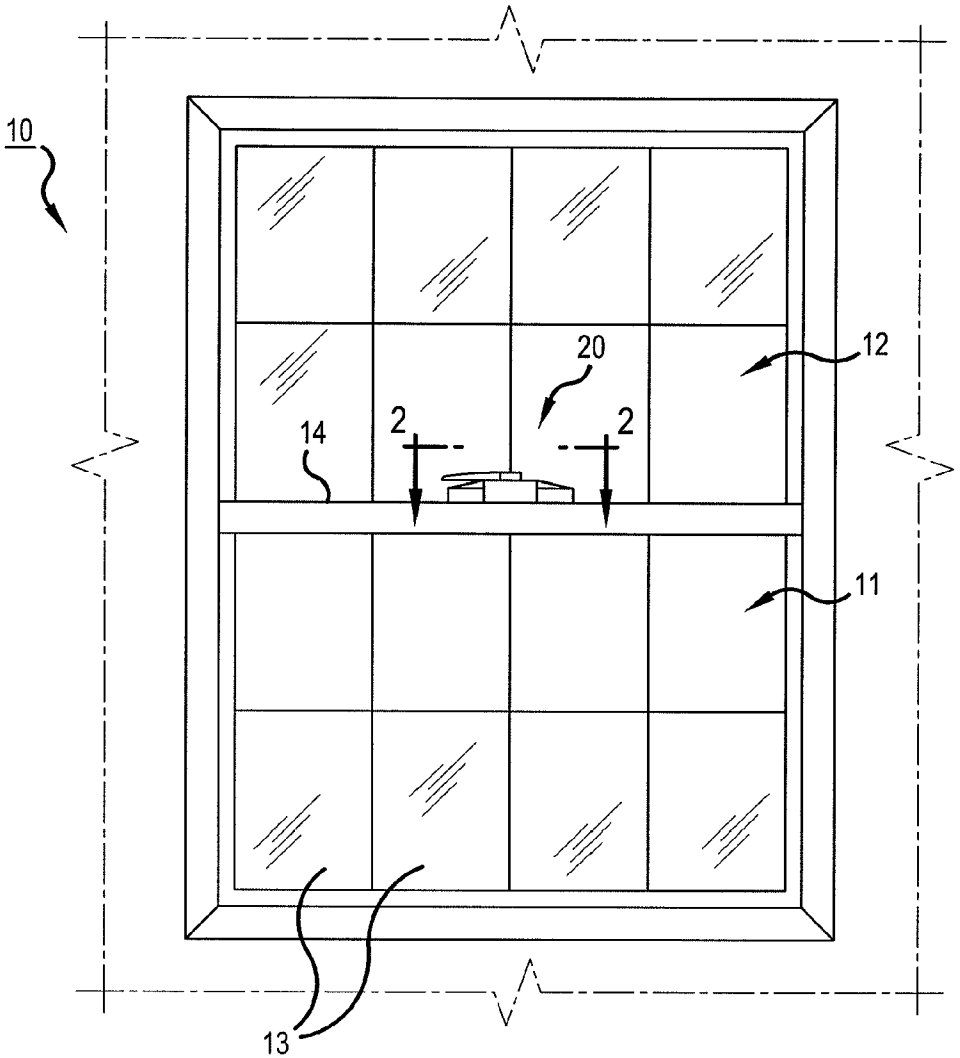
FIG. 1 demonstrates a typical sash type window with the window lock of the invention as seen from inside a building.
Figure 2:
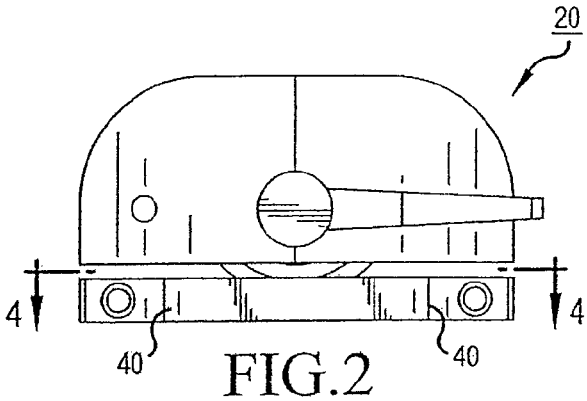
FIG. 2 shows a top plan view of the window lock and keeper as shown along line 2-2 of FIG. 1.
Figure 4:
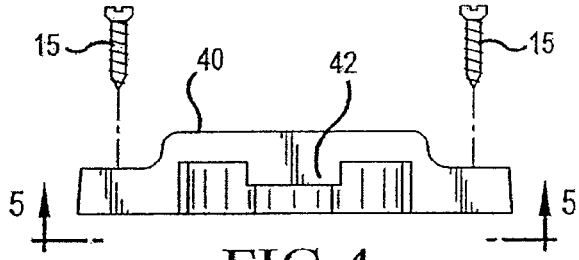
FIG. 4 depicts an elevational view of the keeper as shown in FIG. 2 along line 4-4.
Figure 5:
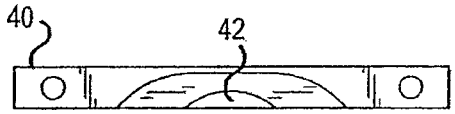
FIG. 5 illustrates a bottom view of the keeper as shown along line 5-5 in FIG. 4.

For a better understanding of the invention and its operation, turning now to the drawings, FIG. 1 illustrates in schematic fashion a typical sash window 10 as used in homes and other buildings. Window 10 includes lower movable sash 11 having eight (8) glass panes 13 and top rail 14. Upper sash 12 may be movable or fixed and includes a bottom rail (not shown) which is coplanar with top rail 14 of sash 11 when window 10 is fully closed as seen in FIG. 1. Preferred sash lock 20 formed from a standard zinc die-cast material is shown mounted to top rail 14 of sash 11, and as would be understood, a keeper such as conventional keeper 40 (FIG. 4, for example) is mounted to the bottom rail (not shown) of upper sash 12 and is aligned for engagement with lock 20. Lock 20 may also be formed from a standard nylon/fiberglass composite material if desired. Lock 20 and keeper 40 are affixed to window 10 as by conventional screws 15 seen in FIGS. 3 and 4, although other suitable attachment means may be utilized. Keeper 40 is also shown in FIGS. 2, 4 and 5 removed from the bottom rail (not shown) of upper sash 12.

Figure 3:
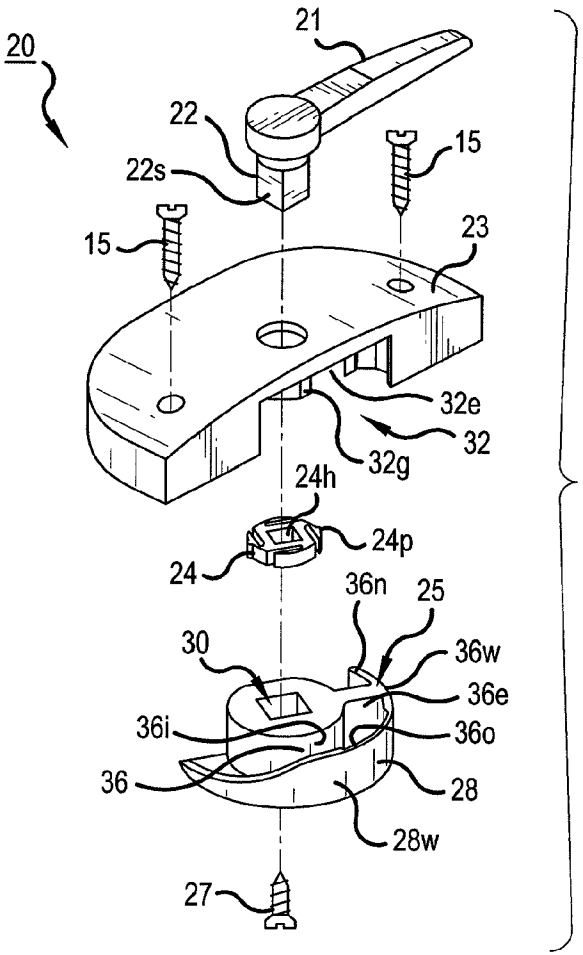
FIG. 3 demonstrates an exploded perspective of the window lock as seen in FIG. 2.

Sash lock 20 is seen exploded in FIG. 3 for clarity purposes. Sash lock 20 includes a handle 21 which is joined to an axle 22 having a rectangular-shaped axle shaft 22*s*. Axle shaft 22*s* passes through a hole in housing 23 and the tension member 24, and then is inserted into the axle port 30 of the cam 25. Threaded member 27 is tightened into a threaded screw hole (not shown) at the lower end of axle shaft 22*s* to maintain structural integrity of the lock during use. Locking and unlocking of window sash 11 is done so manually by rotating handle 21. Rotation of handle 21 causes cam 25 and tension member 24 to likewise rotate.

Figure 8:
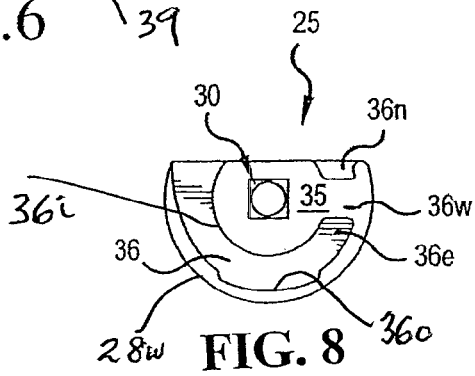
FIG. 8 pictures a top view of the cam as shown in FIG. 7.

As further seen in FIGS. 3 and 8, cam 25 includes a sweep arm 28, and a channel 36 is disposed on an upper surface 35 of the cam and in a position adjacent to the sweep arm 28. The channel 36 has a terminal end 36*e*, a semi-circular shaped axle port outer wall 36*i*, and an elongated-arcuate portion 36*o* of the inner wall of the sweep arm 28. The upper surface of the cam also includes a notch 36*n*formed in a position near terminal end 36*e*. Notch 36*n* and terminal end 36*e* are separated by a wall 36*w*. Sweep arm 28 has an outer wall 28*w* that may be either elongate-shaped or semicircular-shaped.

Figure 7:
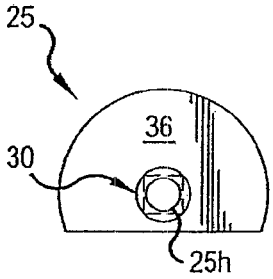
FIG. 7 illustrates a bottom view of the cam as removed from the housing.

As also seen in FIGS. 3, 7, and 8, cam 25 includes rectangular axle port 30, which extends part way from the top 35 to the bottom 36 of cam 25. The bottom 36 of cam 25 includes a hole 25*h* which is in communication with axle port 30. Fastener 27 is inserted through hole 25*h* of the cam 25, through hole 24*h* of the tension member 24, and is tightened in the threaded screw hole (not shown) at the lower end of the axle shaft 22*s*.

Figure 6:
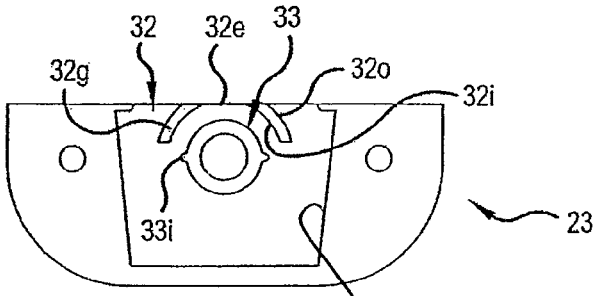
FIG. 6 shows a bottom plan view of the window lock housing as seen in FIG. 3 but with the handle, cam, tension member, and fastener removed.

Housing 23 as seen in FIG. 6 includes indent 32 having an inward facing wall 39. A pair of first and second guide portions 32*g* projecting downwardly are formed at an open edge 32*e* of the indent 32. Inner faces 32*i* of the guide portions 32*g* are semi-circular-shaped, and outer faces 32*o* of the guide portions 32*g* flair outwardly in a direction toward the open edge 32*e* of the indent 32. The guide portions 32*g* fit within the channel 36 of the cam 25.

The housing also includes a groove 33 having a wall that is substantially circular-shaped. A pair of indentations 33*i* are provided on the wall of the groove 33. The resilient tension member 24 is disposed in the groove 33 in a position facing the upper surface 35 of the cam 25 Tension member 24 includes a pair of projections 24*p* for engaging with the indentations 33*i* on the wall of the groove 33 when the axle 22 is rotated to a predetermined position.

Groove 33 maintains resilient tension member 24 therein while cam 25 is maintained within indent 32, and guide portions 32*g* of the housing 23 are contained within channel 36 of the cam 25.

Figure 9:
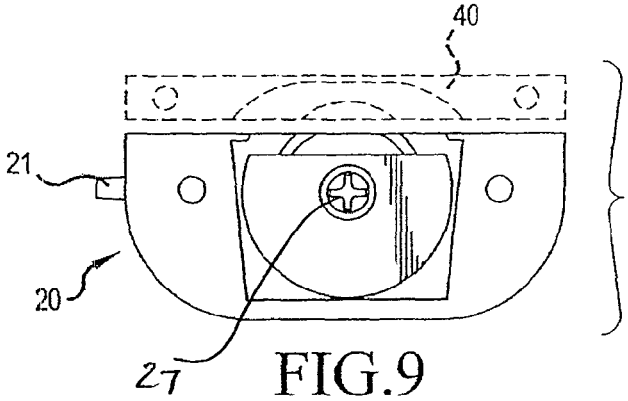
FIG. 9 depicts a bottom view of the window lock as seen in FIG. 2 with the keeper shown in ghost fashion and in an opened or unlocked posture.
Figure 10:
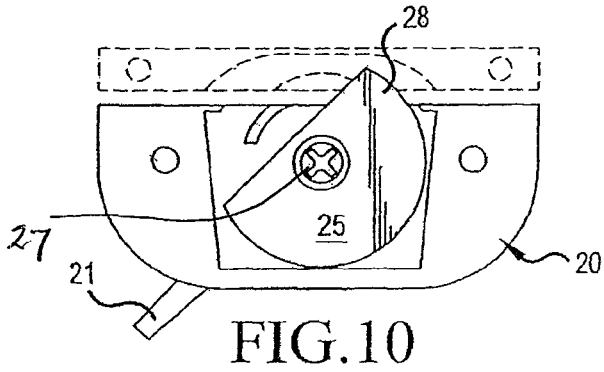
FIG. 10 shows the handle being turned clockwise approximately forty-five to fifty degrees (45-50°) from that shown in FIG. 9 to begin the locking cycle with the keeper.
Figure 11A:
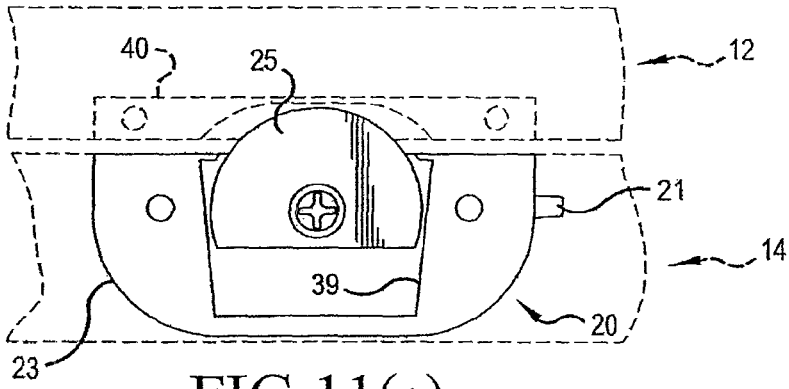
FIGS. 11(*a*) and 11(*b*) illustrate a further progression of the locking cycle with the handle turned clockwise approximately one hundred eighty degrees)(180°)from that shown in FIG. 9.
Figure 11B:
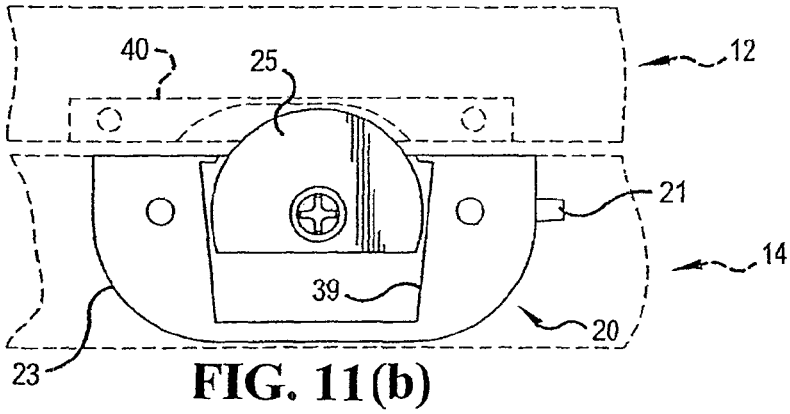

The preferred method of locking window sash lock 20 is seen in various steps in FIGS. 9-11, in which lock 20 and keeper 40 are shown in a bottom plan view. In FIG. 9, keeper 40 is slightly spaced from lock 20 with cam 25 seen in an open, unlocked posture as with window 10 closed. In the open position, projections 24*p* of the tension member 24 are engaged with indentations 33*i* of the groove 33 of housing 23, and an end of the first guide portion 32*g* is disposed in notch 36*n* of cam 25, and against wall 36*w*. As rotation begins in a counterclockwise direction, projections 24*p* of tension member 24 become disengaged from indentations 33*i* of the groove 33.

In FIG. 10, handle 21 has been moved in a counterclockwise direction about forty-five to fifty degrees (45-50°) about an axis of the axle 22 from the position seen in FIG. 9. The cam 25 and the tension member 24 rotate by the same amount. During rotation, the walls 36*i* and 36*o* of cam channel 36 slide past the corresponding faces 32*i* and 32*o* of the first and second guide portions 32*g* of the housing 23.

Upon further counterclockwise rotation by one-hundred eighty)(180°) from the open position as shown in FIGS. 11(*a*) and (*b*), cam sweep arm 28 fully engages keeper catch 42 as seen in FIG. 5 to lock window sash 11. In particular, FIG. 11(*a*) illustrates the security lock 20 when the keeper 40 installed on upper window sash 12 and the housing 23 installed on the top rail 14 of lower window sash 11 are correctly aligned and directly face each other. On the other hand, as can be seen in FIG. 11(*b*), the keeper 40 and the housing 23 are misaligned and do not directly face each other, perhaps due to careless installation of the lock, or inconsistencies in the sizes of the upper and lower sashes. In this situation, where keeper 40 and housing 23 are misaligned and do not directly face each other, the elongated-arcuate portion 36*o* of the inner wall (as shown in FIGS. 3 and 8) of the sweep arm 28 allows cam 25 to "self-locate" relative to the keeper catch 42 of the keeper 40, and to securely fit around the keeper catch 42, whereby security lock 20 is in the securely-locked state.

In either of the situations illustrated in FIGS. 11(*a*) and (*b*), rotation of cam 25 is terminated when the second guide portion 32*g* hits against the terminal end 36*e* of channel 36, and simultaneously the projections 24*p* engage with indentations 33*i* of the groove 33. Thus, additional security to window lock 20 is provided when projections 24*p* engage with indentations 33*i* of the groove 33.

Lock 20 can be opened in an authorized manner by turning handle 21 in the opposite direction to rotate and disengage projections 24*p* from indentations 33*i*, whereby sweep arm 28 is rotated from keeper catch 42, which thus allows sash 11 as seen in FIG. 1 to slide open as desired.

Handle 21, housing 23 and keeper 40 can be manufactured from a variety of conventional materials, designer colors and coatings. A soft or resilient polymeric foam or other coating can be applied as an over molding to the structural material of handle 21, housing 23 and keeper 40 for safety purposes, such as to protect a child that strikes the components in an accidental fall.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lock comprising:

a housing, the housing including an indent with two arc-shaped guide portions projecting downwardly therefrom, the guide portions being formed separately from each other at two positions directly joining an open edge of the indent of the housing, and each of the guide portions having a concave-shaped inner face and a convex-shaped outer face;

a cam including an axle port, the axle port having an axle port outer wall, and the cam being positioned within the indent;

an axle with a shaft adapted to be inserted into the axle port so that the cam and the axle are rotatable together;

the cam including a sweep arm and a channel disposed on an upper surface of the sweep arm, the channel having one side bounded by the axle port outer wall, and an opposite side bounded by an elongated-arcuate portion of an inner wall of the sweep arm which faces the axle port outer wall, and the sweep arm having an outer wall that is curved, whereby upon rotation of the axle, the cam rotates about the guide portions into a locked posture in the housing.

2. The lock of claim 1, wherein each of the guide portions fits within the channel of the cam.

3. The lock of claim 1, wherein the convex-shaped outer face of each of the guide portions flairs outwardly in a direction toward the open edge of the indent.

4. The lock of claim 1, further comprising a handle affixed to the axle.

5. The lock of claim 1, further comprising a fastener for fastening the cam to the axle.

6. The lock of claim 1, wherein the cam includes a hole extending upwardly from a lower surface of the cam and into the axle port, the hole accommodating a fastener for fastening the cam to the axle.

7. The lock of claim 1, where the housing includes a groove having an inner wall which is substantially circular-shaped, the inner wall of the groove having at least one indentation which extends radially outwardly.

8. The lock of claim 7, further comprising a resilient tension member disposed inside the substantially circular-shaped groove, the resilient tension member being rotatable by the axle when the axle is inserted through an opening formed in a center of the tension member, wherein the tension member includes at least one projection extending radial outwardly for engaging with the at least one indentation in the inner wall of the substantially circular-shaped groove when the axle is rotated to a predetermined position.

9. The lock of claim 7, further comprising a resilient tension member disposed in the substantially circular-shaped groove in a position facing the upper surface of the cam, the tension member being rotatable with the axle when the axle is inserted through an opening formed in a center of the tension member.

10. The lock of claim 1, further comprising a keeper having a keeper catch, wherein the elongated-arcuate portion of the inner wall of the sweep arm engages the keeper catch when the cam is rotated to the locked posture, and in a situation where the keeper and the housing are misaligned and do not directly face each other, the elongated-arcuate portion of the inner wall of the sweep arm allows the cam to "self-locate" relative to the keeper catch and to securely fit around the keeper catch, whereby the lock is in a securely-locked state.

11. The lock of claim 1, wherein the upper surface of the sweep arm includes an end wall, a terminal end of the channel being located on one side of the end wall, and a notch being formed on an opposite side of the end wall, and when the lock is in an open posture, an inner end of one of the two guide portions is disposed in the notch and against the end wall.

12. A lock, comprising:

a housing having a lower side with an indent, the indent having two guide portions projecting downwardly from the indent, the guide portions being formed separately from each other at two positions directly joining an open edge of the indent of the housing, and each of the guide portions having a concave-shaped inner face and a convex-shaped outer face;

a cam being positioned within the indent and including an axle port on an upper surface thereof and extending part way through the cam, the axle port having an axle port outer wall;

an axle with a shaft adapted to be inserted into the axle port so that that axle and the cam are rotatable together;

the cam including a sweep arm and a channel disposed on an upper surface of the sweep arm, the channel having one side bounded by the axle port outer wall, and an opposite side bounded by an elongated-arcuate portion of an inner wall of the sweep arm which faces the axle port outer wall, and the sweep arm having an outer wall that is semi-circular-shaped, wherein the guide portions fit within the channel of the cam, and upon rotation of the axle, the cam rotates into a locked posture in the housing.

13. The lock of claim 12, wherein the convex-shaped outer face of each of the guide portions flairs outwardly in a direction toward the open edge of the indent.

14. The lock of claim 12, further comprising a handle affixed to the axle.

15. The lock of claim 12, further comprising a fastener for fastening the cam to the axle.

16. The lock of claim 12, wherein the cam includes a hole extending upwardly from a lower surface of the cam and into the axle port, the hole accommodating a fastener for fastening the cam to the axle.

17. The lock of claim 12, where the housing includes a groove having an inner wall which is substantially circular-shaped, the inner wall of the groove having at least one indentation which extends radially outwardly.

18. The lock of claim 12, further comprising a keeper having a keeper catch, wherein the elongated-arcuate portion of the inner wall of the sweep arm engages the keeper catch when the cam is rotated to the locked posture, and in a situation where the keeper and the housing are misaligned and do not directly face each other, the elongated-arcuate portion of the inner wall of the sweep arm allows the cam to "self-locate" relative to the keeper catch and to securely fit around the keeper catch, whereby the lock is in a securely-locked state.

19. The lock of claim 12, wherein the upper surface of the sweep arm includes an end wall, a terminal end of the channel being located on one side of the end wall, and a notch being formed on an opposite side of the end wall, and when the lock is in an open posture, an inner end of one of the two guide portions is disposed in the notch and against the end wall.

20. A lock, comprising:

a housing having a lower side with an indent, the indent having two guide portions projecting downwardly therefrom, the guide portions being formed separately from each other at two positions directly joining an open edge of the indent of the housing, and each of the guide portions having a concave-shaped inner face and a convex-shaped outer face;

a cam being positioned within the indent and including an axle port on an upper surface thereof and extending part way through the cam, the axle port having an axle port outer wall;

an axle with a shaft adapted to be inserted into the axle port so that that axle and the cam are rotatable together;

the cam including a sweep arm and a channel disposed on an upper surface of the sweep arm, the channel having one side bounded by the axle port outer wall and an opposite side bounded by an elongated-arcuate portion of an inner wall of the sweep arm, and the sweep arm having an outer wall that is semi-circular-shaped, wherein the guide portions fit within the channel of the cam, and upon rotation of the axle, the cam rotates into a locked posture in the housing, and further comprising a resilient tension member disposed inside the substantially circular-shaped groove, the tension member being rotatable by the axle when the axle is inserted through an opening formed in a center of the tension member, wherein the tension member includes at least one projection extending radially outwardly for engaging with the at least one indentation of the substantially circular-shaped groove when the axle is rotated to a predetermined position.

* * * * *